US005407010A

United States Patent [19]

Herschberger

[11] Patent Number: 5,407,010

[45] Date of Patent: Apr. 18, 1995

[54] ARTIFICIAL LIFT SYSTEM

[76] Inventor: Michael D. Herschberger, 1605 Tyler Rd., SE., Kalkaska, Mich. 49646

[21] Appl. No.: 293,384

[22] Filed: Aug. 19, 1994

[51] Int. Cl.[6] ..... E21B 43/00

[52] U.S. Cl. ..... 166/372

[58] Field of Search ..... 166/370, 372, 105.5, 166/105.6, 67, 68

[56] References Cited

U.S. PATENT DOCUMENTS

| | | | |
|---|---|---|---|
| 971,612 | 10/1910 | Holliday . | |
| 1,547,197 | 7/1925 | Arbon . | |
| 1,698,619 | 1/1929 | Blow . | |
| 1,845,675 | 2/1932 | Martin . | |
| 2,001,551 | 5/1935 | Scott . | |
| 2,682,225 | 6/1954 | Coberly . | |
| 2,814,992 | 12/1957 | Humason . | |
| 3,980,138 | 9/1976 | Knopik | 166/314 |
| 4,989,671 | 2/1991 | Lamp | 166/372 X |
| 5,105,889 | 4/1992 | Misikov et al. | 166/372 |
| 5,117,909 | 6/1992 | Wilton et al. | 166/372 X |

*Primary Examiner*—Michael Powell Buiz
*Attorney, Agent, or Firm*—Varnum, Riddering, Schmidt & Howlett

[57] ABSTRACT

An artificial lift system and method for lifting fluids from an underground formation. The artificial lift system comprising a production tubing through which the fluid is carried from the formation to the surface and a pressure reducer, such as a venturi, fluidly connected to the production tubing to artificially raise the level of the fluid in the production tubing above the static level associated with the head pressure of the fluid in the formation. The method comprises reducing the pressure in the production tubing at an upper portion thereof to increase the pressure differential between the production tubing and the annular section of the well bore to increase the level of liquid in the production tubing for subsequent removal in an artificial lifting step.

25 Claims, 2 Drawing Sheets

ARTIFICIAL LIFT SYSTEM

BACKGROUND OF THE INVENTION

1. Field of the Invention

This invention relates to an artificial lift system for removing fluid from an underground formation, and more specifically to an augmented artificial lift system utilizing pressure differentials to increase the efficiency of the artificial lift system.

2. Description of Related Art

Artificial lift systems are commonly used to extract fluids, such as oil, water and natural gas, from underground geological formations. Often times, the formations are more than 1,000 feet below the surface of the earth. The internal pressure of the geological formation is often insufficient to naturally raise commercial quantities of the fluid or gas from the formation through a bore hole. When the formation has a sufficient internal pressure to naturally lift the fluid from the formation, the natural pressure is often inadequate to produce the desired flow rate. Therefore, it is desirable to artificially lift the fluid from the formation by means of an artificial lift system.

Typically, the formation can comprise several separate layers containing the fluid or can comprise a single large reservoir. A bore hole is drilled into the earth and passes through the different layers of the formation until the deepest layer is reached. Due to economic considerations many bore holes extend only to the deepest part of the formation. In certain applications it is desired to extend the bore hole beyond the bottom of the formation. The portion of the bore hole that extends beyond the bottom of the formation is known as a "rat hole." The location and depth of the bore hole is carefully controlled because of the great expense in drilling the bore hole.

After the bore hole is drilled, the bore hole is lined with a casing along its entire length to prevent collapse of the bore hole and to protect surface water from contamination. However, the bore hole is often only lined with the casing to the top of the gas and fluid containing formation leaving the lower section of the bore hole uncased. The uncased section is referred to as an open hole. The casing is cemented in place and sealed at surface by a wellhead and can have one or more pipes, tubes or strings (metal rods) disposed therein and extending into the bore hole from the wellhead. One of the tubes is typically a production tube, which is used to carry fluid to the surface.

Currently, many different types of artificial lift systems are used to lift the fluid from the formation. The most common artificial lift systems are: progressive cavity pumps, beam pumps and subsurface gas lift (SSGL). A progressive cavity pump is relatively expensive, approximately $25,000, to install but can deliver relatively large volumes of fluid and remove all the fluid from the formation. A progressive cavity pump comprises an engine or electric motor driven hydraulic pump connected to a hydraulic motor mounted on the top of the wellhead and connected to a hydraulic pump at the bottom of a production tubing. The hydraulic motor turns a rod string that is connected to a pump rotor, which turns with respect to a pump stator. The pump rotor is helical in shape and forms a series of progressive cavities as it turns to lift or pump the fluid from the bottom of the casing into the production tube and to the surface. Although the progressive cavity pump is satisfactory in raising fluid from the formation, the hydraulic pump system requires a containment building and liner in the event of an oil leak. The possibility of an oil leak in the progressive cavity pump system also raises environmental concerns because many of the bore holes are drilled in environmentally sensitive or wilderness areas. The progressive cavity pump also requires, in certain applications, at least 100 feet of a rat hole, which adds extra cost. Of the previously mentioned artificial lift systems, the progressive cavity pump has the highest maintenance costs and greatest amount of down time requiring rig service. A soft seal stuffing box seals around the rotating rod string and must be lubricated daily and acoustic annular fluid levels must be obtained at regular intervals to ensure that the fluid is adequately high above the pump and that it does not run dry and destroy itself.

A beam pump is also relatively expensive, approximately $15,000, to install but can also remove all the fluid from the formation. The beam pump comprises a pivotally mounted beam that is positioned over the wellhead and connected to a rod string extending into the casing in the bore hole. The lower end of the rod string is connected to a pump disposed near the bottom of the bore hole. The beam pump is operated by a gas engine or an electric motor. If an electric motor is used, it is necessary to run power lines to the beam pump because many of the beam pumps are placed in remote wilderness areas. The beam pump has several disadvantages. First, there are many environmental concerns. There may be leakage in the engine or gear box of the power source, requiring construction of a containment area. Further, if an electric motor is used in place of the gas engine, it is necessary to run a power line to the electric motor, which often destroys or degrades the surrounding environment. The beam pump, like the progressive cavity pump, has several components that require regular lubrication. The beam pump also uses a soft seal stuffing box to seal around the reciprocating rod string.

The SSGL is the least expensive artificial lift system to install, approximately $7,500. The SSGL uses pressurized gas carried by a separate tube from the surface to the lower end of a production tube to raise fluid in the production tube upon injection of the pressurized gas. The production tube usually has a one-way valve at its lower end so that fluid standing in the formation can enter the production tube and rise in the production tube to the level of fluid in the formation. The SSGL can be used with or without a plunger disposed within the production tubing. The SSGL is the most environmentally friendly and maintenance free of the three commonly used artificial lift systems. Unlike the other artificial lift systems, the subsurface gas lift system requires no systematic lubrication of the gas regulator and the motor valve. The SSGL maintains greater integrity of the well head in controlling the possibility of fluid leaks because the well head components are hard piped with no friction oriented soft seal such as is found in the stuffing boxes of the progressive cavity and beam pumps. The SSGL is virtually silent during operation and has relatively little surface equipment compared to a beam pump or progressive cavity pump. Therefore, it has less audible and visual impact on the surrounding environment. The greatest disadvantage of the SSGL is that it becomes less efficient as more and more fluid is drawn from the formation. The SSGL can only raise the column of fluid in the production tubing. The column of fluid in the tubing is equal to the level of fluid in the formation. As more and more fluid is removed from the formation, the level of fluid in the production tubing decreases and a continuously smaller and smaller amount of fluid is raised for substantially the same amount of energy.

As the fluid level in the subsurface gas lift system decreases, there becomes a point where it is no longer cost effective, operationally safe or productive to use the subsurface gas lift system. Often times, the subsurface gas lift system is replaced with a beam pump, and its accompanying undesirable attributes. Optionally, a "rat hole" can be bored with the bore hole in a subsurface gas lift system so that most of the fluid can be raised from the formation by placing the gas injection below the level of the formation and in the rat hole. However, many holes were drilled without a rat hole before artificial lift became a generally accepted method of production and the cost associated with boring a rat hole is such that most companies still prefer to drill little, if any, rat hole.

Another disadvantage that is common to all artificial lift systems in that as the fluid level decreases the system becomes operationally more difficult to efficiently control without damaging itself. In the event of no fluid level, the progressive cavity will quickly torque up and seize the down hole pump or twist off the rod string. The beam pump will begin to pound as gas is drawn into the pump. The end result of which will be a scored pump barrel and eventually a parted rod string. The SSGL may "dry cycle". A condition where the plunger arrives at the surface and bottom of the well with possible damaging velocity. The damage to the progressive cavity and the beam pumps will require a work over rig for repairs. The damage to the SSGL seldom requires more than a small wire line truck for a few hours to retrieve and repair the damaged components. Each of these systems, if controlled improperly, can have catastrophic failures that can be physically dangerous to the operator and can inflict environmental damage.

Therefore, it is desirable to have a cost effective artificial lift system and process for a well that are relatively environmentally safe, low maintenance, operationally predictable, easy to control and which has an acceptable level of efficiency.

SUMMARY OF INVENTION

According to the invention, a method for producing gas from a gas- and liquid-containing underground strata from which a well extends from the surface of the ground to the underground strata. The well has an outer casing through which the gas passes from the strata to the surface of the ground. The gas enters the lower portion of the outer casing which is disposed in the strata and moves through the outer casing to the surface of the ground where it is collected. The well further has a production tubing disposed within the outer casing and from which the liquid is removed from the well by artificially lifting the liquid from a lower portion of the well to the surface of the ground. By removing the liquid from the well, gas is released from the formation and enters the annular section of the well bore to be produced from the formation. A pressure reducing step is used to aid in the removal of the liquid from the well. The pressure reducing step reduces the pressure at an upper portion of the production tubing to increase the pressure differential between the production tubing and the annulus at the surface. The increase in the pressure differential results in an increase in the level of fluid in the production tubing, which fluid is removed in an artificial lifting step.

The pressure reducing step is preferably carried out for a first time period to increase rate the fluid enters the production tube and the level of liquid in the production tubing and the artificial lifting step is carried out subsequent to the first time period. Preferably, the initiation of the lifting step is carried out before the completion of the first time period. The artificial lifting step preferably comprises the injection of a pulse of high pressure gas for a second time period into the lower portion of the production tubing to lift the liquid in the production tubing. Preferably, the pressure reducing step comprises the passing of a high pressure gas through a reduced orifice to create a reduced pressure area adjacent the orifice. A portion of the liquid is drawn in the production tubing and is passed into the reduced pressure area. To this end, the orifice is fluidly connected to the production tubing so that the reduced pressure area is fluidly connected to the production tubing area. In the lifting step, the fluid drawn into the production tubing is lifted by the injection of high pressure gas into the lower portion of the production tubing. In a collection step, the liquid lifted from the production tubing and the gas exiting the annulus are preferably directed to a common tubing where the gas and liquid are mixed and carried to a collecting zone and subsequently separated.

In another aspect of the invention, a gas production well extends between the surface of the ground to the strata, which contains gas and liquid. The well has an outer casing with a fluidly open lower portion through which the gas passes from the strata and wherein the upper portion of the outer casing is connected to a gas collector at the surface of the ground so that the gas passes from the lower portion of the outer casing to the collector through the outer casing. The well further has an inner production tubing disposed within the outer casing and by which the liquid is removed from the well with an artificial lift system. The artificial lift system lifts the liquid from the lower portion of the well to the ground level to release gas from the formation into the casing or annulus. A pressure reducer is fluidly connected to an upper portion of the production tubing to increase the pressure differential at the surface between the production tubing and the annular section of the well bore to thereby increase the rate of fluid entry and the level of liquid in the production tubing for removal by the artificial lift system.

The pressure reducer is preferably a venturi that is fluidly connected to a source of pressurized gas so that when the pressurized gas passes through the venturi a reduced pressure area is formed by the venturi, thereby raising the level of liquid in the production tubing above the level of liquid in the outer casing. The venturi has a tubular body with an axial opening extending therethrough from a first end to a second end and in which is replaceably mounted a nozzle and an induction barrel. The nozzle is retained within the main body by a nozzle retainer threadably mounted within the axial aperture at the first end of the tubular body. The induction barrel is retained within the main body by a barrel retainer threadably mounted within the axial aperture at the second end of the tubular body so that the nozzle retainer and barrel retainer, respectively, provide access to the nozzle and the induction barrel. The tubular body preferably has an annular shoulder extending into the axial aperture and against which the nozzle and the induction barrel abut so that the nozzle and the induction barrel can be compressively mounted between the annular shoulder and the nozzle retainer and barrel retainer, respectively. The spacers can be disposed between either side of the annular shoulder and the nozzle and induction barrel, respectively, to adjust the position of the nozzle and induction barrel within the main body.

In yet another aspect of the invention, the gas production well comprises a production line extending from the outer casing for removal of the gas in the annulus outer casing and the pressure reducer fluidly connected to the production tubing. Also, the gas production well comprises an induction line extending from the production tubing to the pressure reducer for fluidly connecting the pressure reducer to the production tubing.

The invention provides a gas or oil well artificial lift system and process which are relatively environmentally safe, cost effective and efficient.

BRIEF DESCRIPTION OF THE DRAWINGS

The invention will now be described with reference to the drawings in which.

DESCRIPTION OF THE PREFERRED EMBODIMENTS

Figure 1:
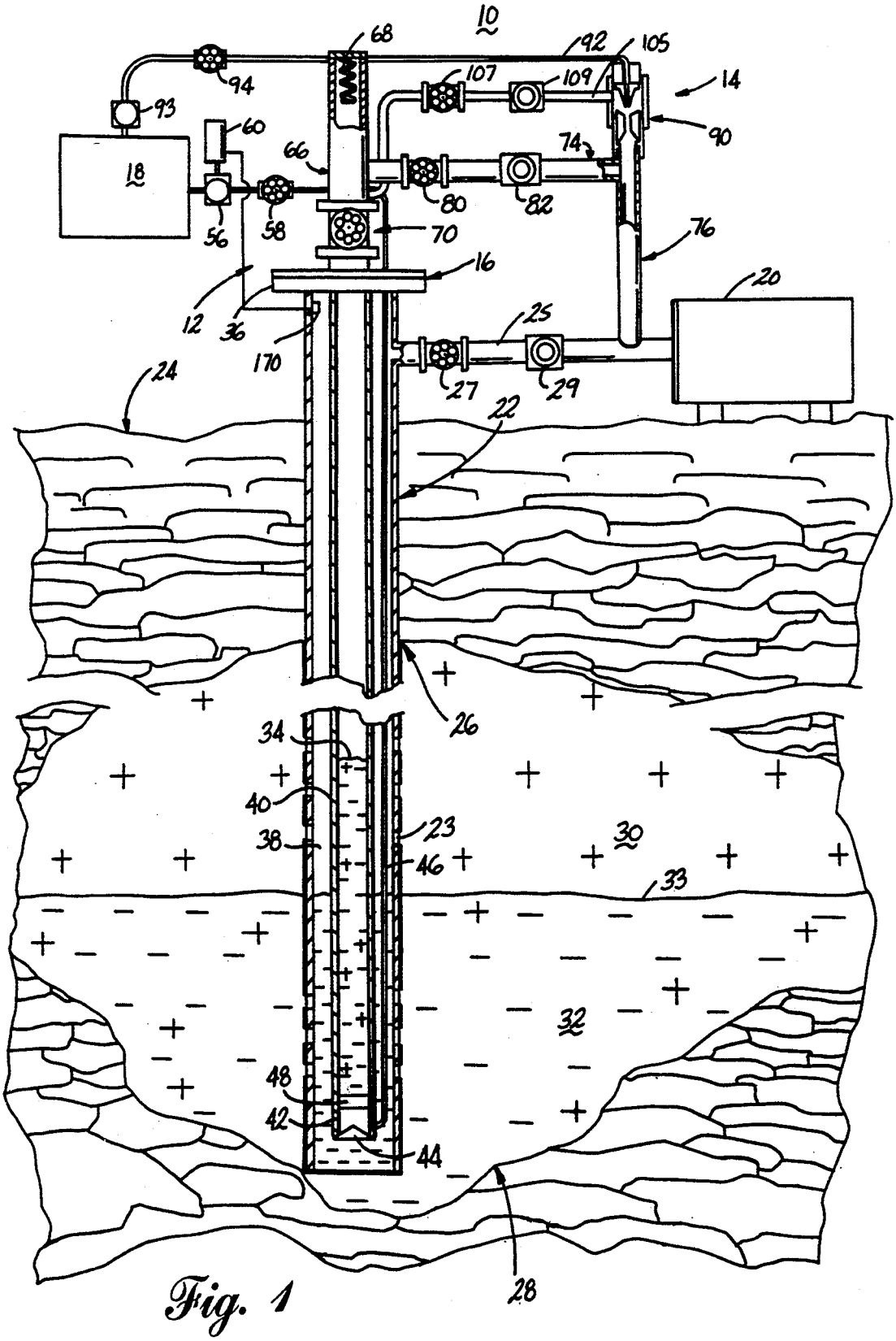
FIG. 1 is a schematic sectional view of a bore hole with an artificial lift system according to the invention.

FIG. 1 illustrates the artificial lift system 10 according the invention and comprises a subsurface gas lift system 12 (SSGL) in combination with an induction system 14. The SSGL 12 and induction system 14 are closed to the atmosphere, creating a closed artificial lift system.

The SSGL 12 comprises well assembly 16 extending from above a surface 24, such as the ground, and into an underground formation 28 and to which is fluidly connected a high pressure gas source 18 and a collector 20 for collecting and separating the fluids.

As illustrated, the formation contains two types of fluid, natural gas 30 and water 32 in the liquid state. However, other types of fluid such as liquid hydrocarbons can be in the formation 28. The natural gas 30 and water 32 are typically separated because of their different densities. The water 32 can have some natural gas in solution. The formation 28 can also hold substantial quantities of natural gas that is retained within the formation 28. The natural gas 30 and water 32 are usually under pressure in the formation 28. The pressure of the fluid in the formation can be caused by the weight of the strata acting on the formation and the pressure of the fluids in the formation 28. This internal pressure of the formation is known as the head pressure. The natural gas 30 and water 32 are at static equilibrium within the formation 28. To deplete the natural gas from the formation 28, it is necessary to remove the water from the formation 28 so that the natural gas in the formation 28 can fill the well casing in the area vacated by the removed water.

The well assembly 16 comprises a casing 22 disposed from the surface 24 and extending into the bore hole 26 and into the formation 28. Preferably, the casing 22 extends substantially to the bottom of the formation 28 and is open at the lower end or has any suitable perforations through which the fluids can pass. However, a rat hole portion (not shown) of the bore hole can be drilled below the bottom of the fluid in the formation and the casing 22 can extend into the rat hole.

The casing 22 is sealed with respect to the atmosphere at its upper end by a wellhead 36. A production tubing 40 extends through the wellhead 36 and extends substantially near the bottom of the bore hole 26. The casing 22 may or may not extend to the bottom of the formation, depending on the application. Although the casing 22 is illustrated as extending the entire length of the bore hole, the casing 22 typically is only disposed to a depth dictated by engineering preference or completion technique because of the relatively high cost of installing the casing 22. However, the casing 22 is present at the surface of the bore hole and cooperates with the wellhead to seal the bore hole with respect to the atmosphere.

An annulus 38 is formed by the inner diameter of the casing 22 and the outer diameter of the production tubing 40. The lower end of the production tubing 40 has an injection mandrel 42 in which is mounted a one-way standing valve 44. A high pressure tubing 46 extends from the high pressure gas source 18, through the wellhead 36 and to the injection mandrel 42. Preferably, the high pressure tubing 46 connects with the injection mandrel 42 above the standing valve 44. When high pressure gas is directed from the high pressure gas source 18 into the production tubing 40 through the high pressure gas tubing 46, the standing valve 44 prohibits the high pressure gas from escaping from the production tubing 40 and keeps the high pressure gas out of the annulus 38. A plunger 48 can be disposed in the production tubing 40 above the inlet for the high pressure tubing 46 and is sized to fit within close tolerance of the inner diameter of the production tubing 40.

An open hole (uncased) section or a series of perforations 23 are formed in the casing so that the fluids, such as the natural gas and water, can enter the annulus 38. The casing 22 also has a production line 25 positioned at the surface 24 and extending to the collector 20 so that the natural gas entering the annulus 38 through the perforations 23 or open hole can be directed to the collector 20. A valve 27 and a check valve 29 are disposed within the production line 25 between the casing 22 and the collector 20. The valve 27 and the check valve 29 control the flow of fluid from the annulus 38 to the collector 20. Preferably the valve 27 is a manually operated valve to close the production line 25, whereas the check valve 29 is a one-way valve that permits the flow of the fluid from the annulus 38 to the collector 20 but prohibits flow from the collector into the annulus.

A motor valve 56 and a valve 58 are fluidly connected to the high pressure gas source 18. A high pressure fluid line 46 extends from the motor valve 56 to the injection mandrel 42 of the production tubing 40. Preferably, the motor valve 56 and the valve 58 are disposed above the surface 24. The valve 58 is preferably a manually operated valve for opening and closing the high pressure tubing 46 when desired. The motor valve 56 is connected to a controller 60 having a timer. The controller 60 can be programmable and opens and closes the motor valve 56 so that the high pressure gas from the high pressure gas source 18 can be injected into the production tubing 40 at predetermined intervals. The controller may be connected to a pressure transducer 170 positioned on the production tubing 40 or on the annulus 38. The pressure transducer 170 reads the gas pressure at the top of the production tubing 40 or may read a pressure differential between the production tubing 40 and the annulus 38.

A lubricator 66 is mounted to the wellhead 36 above the production tubing 40 and is fluidly connected to the production tubing 40. The lubricator 66 is an extension of the production tubing 40. The lubricator preferably has a biasing device, such as a spring 68, positioned at the upper end of the lubricator 66 when a plunger 48 is disposed in the production tubing 40. The spring 68 functions to stop the upper movement of the plunger 48. The lubricator 66 may consist of any device with an outlet to the injection line 74 if a plunger 48 is not disposed in the production tubing 40. A valve 70 is disposed at the top of the production tubing 40 and is preferably manually operated to open and close the flow of fluid through the production tubing 40 and lubricator 66 when desired.

An injection line 74 extends from the lubricator 66, preferably above the valve 70, and connects with the production line 25 via the commingling line 76. A valve 80 and a check valve 82 are disposed within the injection line 74. The valve 80 is a manually operated valve to open and close the injection line 74, whereas the check valve 82 is preferably a one-way valve for controlling the flow of fluid from the lubricator 66 to the production line 25, but preventing the flow of fluid from the production line 25 to the injection line 74. The check valves 29 and 82 keep fluid from back flowing from the commingling line 76 into the production tubing 40 or the casing 22.

The check valves 29 and 82 fluidly isolate the annulus 38 and the production tubing 40 from each other at the surface and so let them equalize in pressure with respect to the commingling line 76 and prevent back flow at the end of the high pressure gas injection. Because the production tubing 40 and the annulus 38 are fluidly connected to commingling line 76 they are equalized in pressure and the fluid can reach a static equilibrium in the production tubing 40 and the annulus 38. During the injection of high pressure gas 18 down the high pressure tubing 46 and the ejection of fluids up the production tubing 40 through the injection line 74 and into the commingling line 76, the check valve 29 directs the fluid flow to the collector 20 rather than allowing the fluid to reenter the annulus 38. The check valve 82 fluidly separates the induction line 105 from the annulus 38 to allow the inductor 14 to reduce the pressure on the production tubing 40 to a pressure below that of the commingling line 76 and thus the annulus 38.

Although only one plumbing arrangement is shown in FIG. 1, there are many possible variations. It is important to understand that the induction unit 14 and the well head plumbing can be reconfigured so as to eliminate various components as long as a pressure differential is obtained to elevate the fluid height in the production tubing 40 above the fluid level in the formation.

There are several pressure measurements relevant to determining the bottom hole or head pressure in the artificial lift system and the impact of the induction unit 14 on bore hole 26 equilibrium and therefore the induced fluid level 34 within the production tubing 40. Pressures in the bore hole 26 and the production tubing 40 are commonly referred to in the terms of pressure gradients. "Gradient" is defined as lbs. per square inch (psi) per vertical foot in the bore hole. For example, fresh water will have gradient of 0.433 psi per vertical foot where as an unpressurized gas gradient may be as low as 0.002 psi per vertical foot. In effect, a 1000 foot column of fresh water will have a bottom hole or head pressure of 433 psi where as a 1000 foot column of unpressurized gas would have a bottom hole or head pressure of 2 psi. Most artificial lift systems discharge there fluids or gas into a pressurized production line 25, such as a pipeline system that directs the fluids or gas to a collector, such as collector 20, at the production facility. This gathering system pressure promotes flow from the well head to the production facility, it also aids in the separation of the gas and fluid in that the collector 20 may require pressure to discharge the fluid from the collector 20 to a tank. Also the compressors used to compress the gas up to sales line pressure, except in rare configurations, require a positive inlet pressure to perform efficiently.

The low pressure area created in the production tubing 40 causes the annulus 38 and the production tubing 40 to go out of static equilibrium. The pressure of the gas and fluid in the annulus 38 will raise an induced column of fluid 34 in the production tubing 40 above the static fluid level in the formation 33 until the sum of the surface pressure in the production tubing 40 and the pressure gradients in the production tubing 40 are equal to the sum of the surface pressure in the annulus 38 and the pressure gradients in the annulus 38. This induced fluid level is expressed in the formula:

$$(((APTGP-AAGP)*TD)+SDP)/FG=IFL$$

Where APTGP is average production tubing 40 gradient pressure, AAGP is average annulus 38 gradient pressure to bottom of production tubing 40, TD is depth in feet to the bottom of the production tubing 40, SDP is surface pressure differential in psi between the production tubing 40 and the annulus 38, FG is the gradient pressure per foot of the fluid 32 in the bore hole 26, and IFL is the induced fluid level 34 in feet above the static fluid level 33 in the formation 28.

The pressure associated with the production tubing 40 is similar to the pressure in the annulus 38 in that there is a production tubing 40 gas and fluid gradient that is equal to the annulus 38 gas and fluid gradient when the system is in static equilibrium.

Figure 2:
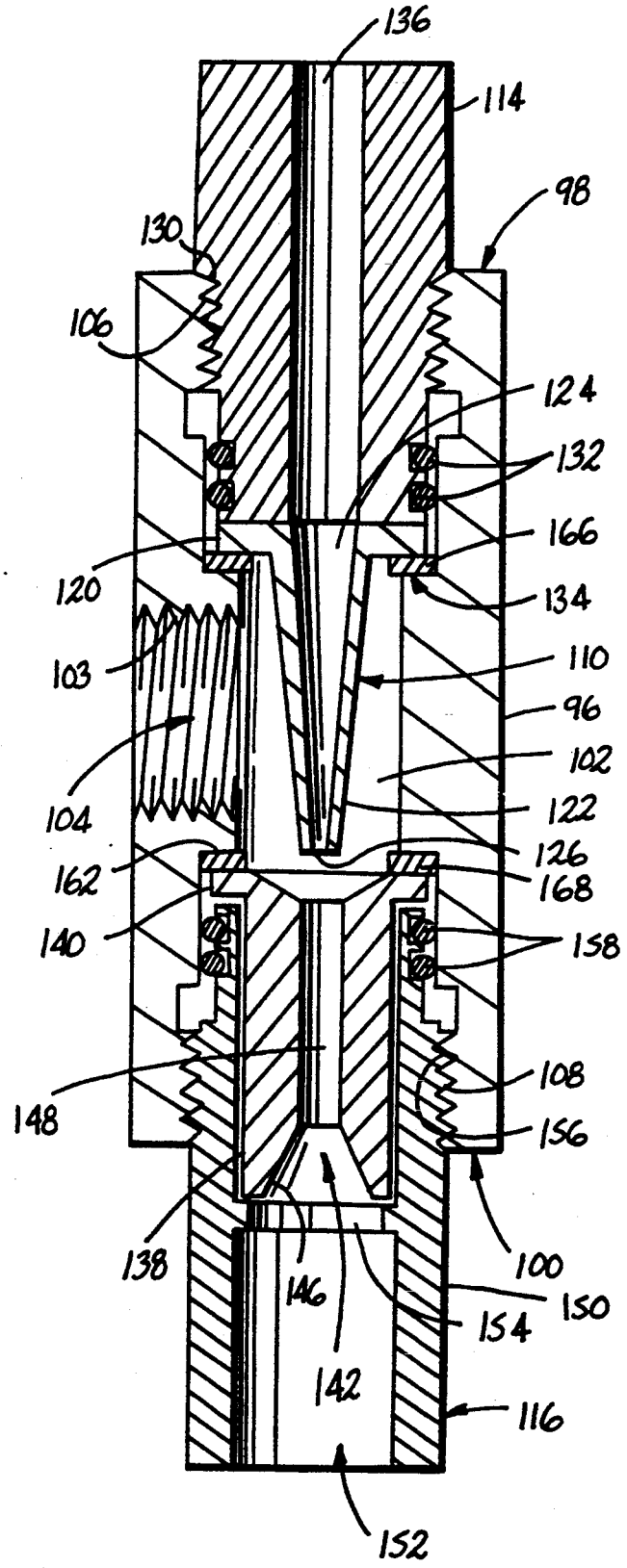
FIG. 2 is an enlarged sectional view of the induction system for the artificial lift system of FIG. 1.

Referring to FIGS. 1 and 2, the induction system 14 comprises a pressure reducer or inductor 90 that is fluidly connected to the production tubing 40 via the lubricator 66 and creates a low pressure area in the production tubing 40 to raise the induced level of water 34 in the production tubing 40 above the level of the static fluid level 33 in the formation 28. The fluid level 33 in the formation and annulus is referred to as the static level. The level of water in the annulus 38 is the same as the static level of water 33 in the formation 28 because the formation 28 and the annulus 38 are fluidly connected by the perforations 23 or the open end of the casing. As illustrated, the inductor 90 works on the venturi principle. However, it should be noted that other suitable devices capable of developing a reduced or low pressure in the production tubing can also be used within the scope of the invention.

The inductor 90 is also fluidly connected to the high pressure gas source 18 by a high pressure gas line 92 and to the injection line 74. A regulator 93 is disposed in the high pressure gas line 92 to control pressure on the induction nozzle and a valve 94 is disposed in the high pressure gas line 92 to shut off the high pressure gas 18 flow if desired.

The inductor 90 comprises a main body 96 that is generally tubular in cross section and which has a first an upper end 98 and a second lower end 100. An axial bore 102 extends through the main body 96 from the first end 98 to the second end 100. The first end 98 is adapted to receive gas from the high pressure gas source 18 through a nozzle retainer inlet 136. The second end 100 is adapted to be connected to the commingling line 76 so that the high pressure gas entering the main body 96 through the first end 98 will exit the second end 100 into the commingling line 76.

A transverse bore 104 is disposed in the side of the main body 96 and is oriented perpendicularly with respect to the axially bore 102. Preferably, the transverse bore 104 has threads 103 for receiving the threaded end of an induction line 105 that extends from the lubricator 66 to the inductor 90 to fluidly connect the inductor 90 to the lubricator 66 and production tubing 40. Alternatively, the transverse bore 104 could be connected to the injection line 74.

The induction line 105 has a valve 107 and a check valve 109 disposed in-line between the production tubing 40 and the inductor 90. The valve 107 is manually activated and opens and closes the induction line 105. The check valve 109 is a one-way valve that prohibits the back flow of fluid from the inductor to the production tubing 40 in the event of a system failure.

The inductor 90 further comprises a nozzle 110 and an induction barrel 112 mounted within the axial bore 102 of the main body 96. Preferably the nozzle 110 and the induction barrel 112 are held within the axial bore 102 by nozzle retainer 114 and barrel retainer 116. The nozzle retainer 114 is adapted to receive and mount the high pressure line 92. Likewise, the barrel retainer 116 is adapted to receive and mount the injection line 74 or the commingling line 76.

The nozzle 110 has an annular shoulder 120 from which extends a conical portion 122. An axially oriented aperture 124 extends from the annular shoulder 120 to a terminal end 126 of the conical portion 122. The aperture 124 decreases in diameter as it approaches the terminal end 126 to define a converging profile.

The nozzle retainer 114 has a series of threads 130 that cooperate with the threads 106 of the main body 96 to secure the nozzle retainer 114 to the main body 96. The threaded connection between the nozzle retainer and main body provides ease of access for assembly, inspection and maintenance. One or more O-rings 132 are disposed about the circumference of the lower end of the nozzle retainer 114 to form a fluid seal between the nozzle retainer 114 and the main body 96.

To secure the nozzle 110 within the main body 96, the annular shoulder 120 of the nozzle 110 is abutted against an annular shoulder 134 extending into the axial bore 102 of the main body 96. The nozzle retainer 114 is then positioned in the first end 98 of the main body 96 and threaded into the threads 106. As the nozzle retainer 114 is tightened, the O-rings 132 form a seal against the sides of the axial bore 102. The nozzle retainer 114 is tightened until the end of the nozzle retainer 114 abuts the annular shoulder 120 of the nozzle 110 to compressively hold the nozzle 110 between the nozzle retainer 114 and the shoulder 134.

The induction barrel 112 comprises a body 138 having an annular shoulder 140. An aperture 142 extends axially through the body 138 and annular shoulder 140. The aperture preferably comprises a converging inlet 144 connected to a diverging outlet 146 by a substantially constant diameter portion 148.

The barrel retainer 116 comprises a body 150 having an axially extending aperture or barrel retainer outlet 152. An annular shoulder 154 extends into the barrel retainer outlet 152. A portion of the body 150 has threads 156 for engaging the threads 108 of the main body 96. One or more O-rings 158 are placed about the circumference of the end of the body 150.

To mount the induction barrel 112 within the main body 96 of the inductor 90, the induction barrel 112 is disposed within the axial bore 102 of the main body 96 until the shoulder 140 of the induction barrel 112 abuts an annular shoulder 162 of the main body 96. The barrel retainer 116 is then threaded into the main body 96 via threads 156 and 108. As the barrel retainer 116 is threaded into the main body 96, the O-rings 158 form a seal between the barrel retainer 116 and the main body 96. The barrel retainer 116 is threaded until the annular shoulder 140 of the barrel is compressed between the annular shoulder 162 of the main body and the end of the barrel retainer 116.

Spacers 166 can be disposed between the annular shoulder 120 of the nozzle 110 and the shoulder 134 of the body 96 to adjust the position of the nozzle 110. Although spacers 166 generally provide enough adjustment between the nozzle 110 and the induction barrel 112, spacers 168 can be disposed between the shoulder 162 of the body 96 and the annular shoulder 140 of the induction barrel 112 to adjust the position of the induction barrel 112. By adjusting the position of the nozzle 110 and induction barrel 112 with different thickness or multiple spacers 166 and 168, respectively, the position of the nozzle 110 with respect to the induction barrel 112 can be adjusted to control the flow of fluid exiting the induction line 105 and entering the induction barrel 112. In most applications, the spacing between the nozzle 110 and the induction barrel 112 can be very critical, especially because the speed of the gas exiting the terminal end 126 of the nozzle 110 can approach 400 mph.

Referring to FIGS. 1 and 2, prior to initiation of the artificial lift system 10, the fluid in the production tubing 40 and the formation 28 is in static equilibrium. Because the system is in static equilibrium, little or no fluid in the form of natural gas can escape from the formation 28 into the annulus 38. To promote the escape of natural gas from the formation 28 and into the annulus 38, it is necessary to lower the head pressure of the fluids in the formation 28 by removing the water 32 from the formation 28. By removing the water, the gas in the formation has a greater volume in which to expand. The available volume results in a temporary reduction in the fluid head pressure so that natural gas stored in the formation can migrate into the annulus 38 for withdrawal into collector 20 through the production line 25.

Prior to activating the artificial lift system 10, the valves 27, 58, 70, 80, 94, and 107 are all moved to the open position. The annulus 38 pressure gradient, and the production tubing 40 pressure gradient and surface pressures equalize via the injection line 74 the commingling line 76 and the production line 25, having the effect of equalizing the static fluid levels 33 in the formation 28, the annulus 38 and production tubing 40. Once the valves 70, 58, 27, 80, 94 and 107 are opened, the high pressure gas is directed into the induction system 14 to begin reducing the production tubing 40 surface pressure. As the high pressure gas flows into the inductor it passes through the nozzle inlet 136 of the nozzle retainer 114 until it encounters the converging aperture 124 of the nozzle 110. As the high pressure gas is directed from the terminal end 126 of the converging aperture of the nozzle 110, the gas is accelerated and directed into the converging inlet 144 of the induction barrel 112. The high pressure gas is then directed through the induction barrel where its speed is slowed by expansion in the constant diameter portion 148 of the induction barrel 138 and exiting through the outlet aperture 152 into the collector 20 via the injection line 74, the commingling line 76 and the production line 25.

The accelerated high pressure gas exiting the nozzle 110 results in the formation of a low pressure area within the axial bore 102 of the main body 96 adjacent the transverse opening 104. The low pressure area formed in the axial bore results in the higher pressure gas in the production tubing 40 above the fluid level in the production tubing 40 to flow from the-production tubing 40 through the induction line 74 and out to the collector 20 with the high pressure gas from the high pressure gas source 18. The reduced pressure created by the inductor 90 causes the gas in the production tubing 40 to flow to the collector 20 therefore reducing the production tubing pressure gradient and upsetting the static equilibrium of the system.

As the pressure in the production tubing 40 decreases, water 32 is drawn into the production tubing 40 in an attempt by the system to obtain static equilibrium. As the high pressure gas continues to flow through the inductor 90, the pressure in the length of production tubing 40 above the liquid level will decrease. The fluid system attempts to reach a static equilibrium by raising a induced column of fluid in the production tubing 40 above the static level 33. This induced fluid level is expressed in the formula:

$$(((APTGP-AAGP)*TD)+SDP)/FG=IFL$$

Where APTGP is average production tubing 40 gradient pressure, AAGP is average annulus 38 gradient pressure to bottom of production tubing 40, TD is depth in feet to the bottom of the production tubing 40, SDP is surface pressure differential in psi between the production tubing 40 and the annulus 38, FG is the gradient pressure per foot of the fluid 32 in-the bore hole 26, and IFL is the induced fluid level 34 in feet above the static fluid level 33 in the formation 28.

After the high pressure gas is passed through the inductor for the time necessary to achieve maximum differential plus 1 to 3 minutes to ensure the maximum amount of water is lifted and to ensure that the well bore will not dewater and dry cycle, the controller 60 opens the motor valve 56 for a predetermined period of time, and high pressure gas from the high pressure gas source 18 passes down the high pressure tubing 46 where it is injected into the production tubing 40 through the injection mandrel 42. Alternatively, a pressure sensor 170 can be positioned on the tubing or the annulus and when the pressure in the tubing or annulus reaches a predetermined level, the high pressure gas will be injected into the production tubing 40 for a predetermined time period. As the high pressure gas enters the production tubing, the standing valve 42 is closed by the increased pressure from the high pressure gas and the plunger 48 is driven upwardly within the production tubing 40 by the blast of pressurized gas, lifting the raised column of fluid above the plunger toward the surface 24 and the lubricator 66. The rising column of fluid is directed into the injection line 74, through the commingling line 76 and finally into the production line 25 and eventually to the collector 20. The advance of the plunger 48 is slowed by the compression of the water as the water and plunger reach the top of the lubricator 66. The plunger 48 contacts the spring 68 and is directed back toward the injection mandrel 42. Some of the water lifted by the plunger 48 will enter the induction line 105 and pass through the inductor 90 on its way to the collector 20 via the production line 25.

Upon the removal of the column of fluid from the formation, the system is not equalized and fluid, such as natural gas, will be released from the strata of the formation and migrate toward the well bore. Some of the natural gas will enter the annulus 38 through the perforations 23 or open bore hole section and will move upwardly in the annulus 38 because of the head pressure and the density differential between the natural gas and the water in the formation, and pass through the production line 25 to the collector 20. The combined fluid of water and gas entering the collector 20 is then separated into the natural gas and water components. The natural gas is then stored or shipped to the appropriate facility. The process is repeated until the water is substantially removed from the formation.

The invention provides a dramatic increase in the efficiency and applicability of artificial lift systems and processes, especially subsurface gas lift systems and processes. The invention greatly increases the efficiency of the subsurface gas lift system and method by enhancing the ability of the subsurface gas lift system and method to lift a greater amount of fluid from the formation during each lifting cycle, resulting in a dramatic increase in the production of natural gas from the formation. Further, the invention also enables the subsurface gas lift system to remove substantially all of the water from the formation and, thus, substantially all the natural gas, whereas previous subsurface gas lift systems could not economically remove all of the water from the formation, requiring the installation of the less desirable beam pump to complete the dewatering process or leaving unretrievable natural gas in the formation. The inability of previous subsurface gas lift systems to extract all the water from the well encouraged the use of the more expensive and less environmentally friendly artificial lift systems, such as beam pumps, which increased the cost of gas production. Therefore, the invention increases the efficiency and production of natural gas, while simultaneously reducing the cost of producing the natural gas and increasing the environmental and operational safety by offering a systematic method of control.

While particular embodiments of the invention have been shown, it will be understood, of course, that the invention is not limited thereto since modifications may be made by those skilled in the art, particularly in light of the foregoing teachings. For example, although the fluid in the formation is described as natural gas and water, the fluid can also be liquid hydrocarbons, such as oil, alone or in combination with natural gas. Reasonable variation and modification are possible within the scope of the foregoing disclosure of the invention without departing from the spirit of the invention.

The embodiments of the invention in which an exclusive property or privilege is claimed are defined as follows:

1. In a method of producing gas from a gas and liquid containing underground strata in which a well extends between the surface of the ground and the strata and the well has a production tubing extending from the surface of the ground into the strata and from which the liquid is removed from the well and the well has at least at an upper portion thereof a casing which defines with the production tubing an annulus through which gas from the lower portion of the strata passes and is collected at the surface of the ground, and the liquid is artificially lifted from a lower portion of the well to the surface of the ground through the production tubing to release the gas from the formation to the annulus, the improvement comprising the step of:

reducing the pressure in the production tubing at an upper portion thereof to create a pressure differential between the upper portion of the production tubing and an upper portion of the annulus to thereby increase the volume of liquid in the production tubing for subsequent removal in the artificial lifting step.

2. The method of claim 1 wherein the pressure reducing step is carried out for a first time period to increase the volume of liquid in the production tubing prior to the lifting of the liquid to the surface of the ground and the artificial lifting step is carried out subsequent to the first time period to lift the liquid to the surface of the ground.

3. The method of claim 2 wherein the artificial lifting step comprises injecting a high pressure gas for a second time period into the lower portion of the production tubing to lift the liquid in the production tubing.

4. The method of claim 3 wherein the second time period begins prior to the completion of the first time period.

5. The method of claim 3 wherein the second time period begins after the completion of the first time period.

6. The method of claim 1 wherein the pressure reducing step comprises passing a high pressure gas through a reduced orifice fluidly connected to the production tubing to create a reduced pressure area adjacent the orifice and drawing a portion of the liquid from the strata into the reduced pressure area in the production tubing to be artificially lifted to surface.

7. The method of claim 6 wherein the artificial lifting step comprises injecting a high pressure gas into the lower portion of the production tubing to lift the liquid in the production tubing.

8. The method of claim 7 wherein the pressure reducing step is carried out for a first time period and the artificial lifting step is carried out subsequent to completion of the first time period to increase the volume of liquid in the production tubing prior to the lifting of the liquid to the surface of the ground.

9. The method of claim 8 wherein the liquid lifted from the production tubing and the gas exiting the outer casing are directed to a common tubing where the gas and liquid are mixed and carried to a collection zone where the gas is separated from the liquid.

10. The method of claim 1 wherein the gas production well is closed with respect to the atmosphere.

11. The method of claim 1 wherein the liquid lifted from the strata is petroleum.

12. The method of claim 1 wherein the liquid lifted from the strata is water.

13. The method of claim 1 comprising the step of providing a controller for controlling the initiation of the artificial lifting step.

14. The method of claim 1 wherein the pressure differential is between the pressure at the top of the production tubing and the pressure at the top of the annulus.

15. In a gas production well wherein gas is produced from a gas and liquid containing underground strata in which a well extends between the surface of the ground and the strata and the well has a production tubing extending from the surface of the ground into the strata and from which the liquid is removed from the well and the well has at least at an upper portion thereof a casing which defines with the production tubing an annulus through which gas from the lower portion of the strata passes and is collected at the surface of the ground, and the liquid is artificially lifted by an artificial lift system from a lower portion of the well to the surface of the ground through the production tubing to release the gas from the formation to the annulus, the improvement comprising:

a pressure reducer fluidly connected to an upper portion of the production tubing to create a pressure differential between the upper portion of the production tubing and an upper portion of the annulus to thereby increase the volume of liquid in the production tubing for subsequent removal of the artificial lifting system.

16. In a gas production well according to claim 15 wherein the pressure reducer is a venturi fluidly connected to a source of pressurized gas so that when the pressurized gas passes through the venturi a reduced pressure area is formed by the venturi, thereby increasing the volume of liquid in the production tubing.

17. In a gas production well according to claim 16 wherein the venturi comprises a tubular body having an axial opening extending through the tubular body from a first end to a second end and in which is replaceably mounted a nozzle and an induction barrel.

18. In a gas production well according to claim 17 wherein the venturi further comprises a nozzle retainer threadably mounted within the axial aperture of the tubular body at the first end to retain the nozzle within the tubular body and a barrel retainer threadably mounted within the axial aperture of the tubular body at the second end to retain the induction barrel within the axial aperture of the tubular body, whereby the nozzle retainer and barrel retainer provide access to the nozzle and the induction barrel.

19. In a gas production well according to claim 18 wherein the tubular body has an annular shoulder extending into the axial aperture, the nozzle abuts one side of the annular shoulder and the nozzle retainer abuts the nozzle to compressively mount the nozzle within the tubular body.

20. In a gas production well according to claim 19 wherein spacers can be placed between the nozzle and the annular shoulder to adjust the position of the nozzle within the axial aperture.

21. In a gas production well according to claim 19 wherein the induction barrel abuts the another side of the annular shoulder and the barrel retainer abuts the induction barrel to compressively mount the induction barrel within the tubular body.

22. In a gas production well according to claim 19 wherein spacers can be placed between the induction barrel and the annular shoulder to adjust the position of the induction barrel within the axial aperture.

23. In a gas production well according to claim 15 and further comprising a production line extending from the casing for removal of the gas in the casing and the pressure reducer being fluidly connected to the production tubing.

24. In a gas production well according to claim 23 and further comprising an induction line extending from the production tubing to the pressure reducer for fluidly connecting the pressure reducer to the production tubing.

25. In a gas production well according to claim 23 wherein the pressure reducer is a venturi fluidly connected to a source of pressurized gas so that when the pressurized gas passes through the venturi a reduced pressure area is formed adjacent the venturi to increase the volume of liquid in the production tubing.

* * * * *